United States Patent [19]

Nelson

[11] 4,112,863

[45] Sep. 12, 1978

[54] BARGE-SUPPORTED CRANE WITH HYDRAULICALLY ACTUATED RAM CORNER LIFT MEANS

[76] Inventor: Christian E. Nelson, 216 Brookvale Rd., Kinnelon, Smoke Rise, N.J. 07405

[21] Appl. No.: 829,450

[22] Filed: Aug. 31, 1977

[51] Int. Cl.[2] ..... B63B 35/44

[52] U.S. Cl. ..... 114/264; 212/3 A

[58] Field of Search ..... 114/51, 264, 265, 268, 114/270; 212/3, 1, 58 R; 214/14, 15 R, 15 C

[56] References Cited

FOREIGN PATENT DOCUMENTS 267,849 12/1913 Fed. Rep. of Germany ..... 212/3

*Primary Examiner*—Trygve M. Blix
*Assistant Examiner*—Jesus D. Sotelo
*Attorney, Agent, or Firm*—Ralph R. Roberts

[57] ABSTRACT

There is shown a barge-type ocean going vessel which on each corner has four hydraulically operated rams having foot portions on their downward ends. These rams are adapted to push downwardly to engage the bottom of the bay or harbor in which the barge is located. As they become seated on the harbor floor, the rams are advanced sufficiently to lift the barge above a bouyancy level. Within this barge is secured a crane which is liftable by a plurality of hydraulically operated jack screws. These screws lift the crane above the deck of the barge sufficiently for the crane to swing in any direction to do any lifting job normal to a crane. The platform upon which this crane is carried has arms extending therefrom, which arms are adapted to be swung to the side of the barge and secured thereto in such a manner that a load on the crane is transferred from the platform upon which the crane is mounted to the side of the barge. When the crane is stored, it is swung lengthwise of the barge and is lowered below deck. A hatch covers the crane opening in the deck. This hatch cover rests upon a gasket and is retained in position to make the interior of the barge more-or-less air tight. Inert gas is carried on this barge and is flooded into the crane compartment so that unwanted oxidation of the crane machinery by salt spray and/or salt air is inhibited. An operator hatch and a ladder are also shown. The storage of inert gas and an indicator depicting the presence of this gas is also contemplated.

15 Claims, 9 Drawing Figures

BARGE-SUPPORTED CRANE WITH HYDRAULICALLY ACTUATED RAM CORNER LIFT MEANS

BACKGROUND OF THE INVENTION

1. Field of the Invention

The classification of art as established by the U.S. Patent and Trademark Office is believed to place this invention in the general Class entitled, "Ships" (Class 114) and in the subclass entitled, "miscellaneous" (subclass 0.5) and the subclass entitled, "hoisting" (subclass 51).

2. Description of the Prior Art

Barges and those equipped with cranes are well known and are shown in several U.S. patents. Barges with hydraulically or otherwise actuated rams with pad ends adapted to extend out to the floor of the shallow water in which the barge is to be used are also known. In general, barges and cranes mounted on barges include barges in which the crane is mounted upon the top deck for transportation and use. It is believed novel to provide safe storage of the crane without damage from the elements or salt air during non-use or transporting. In the present invention there is provided a barge which may be powered or may be a towed unit. This barge has mounted on each of its four corners a hydraulically actuated ram upon whose end is mounted a foot or platform which is adapted to engage the bottom of the river or harbor in which the barge or crane is to be used. These hydraulic rams and the foot portions thereon are moved selectively downwardly to cause the barge to be lifted to a position above high tide buoyancy so that the barge is lifted and not affected by tides or waves and is a stable platform above nominal high water activity. With the barge thus placed or positioned, a hatchway cover is removed allowing the crane to be brought upwardly by means of hydraulic screws or the like. Four screws are depicted as bringing the crane into a condition above the deck of the barge so that it can be normally operated in a 360° rotation. The platform which carries the crane has four or six levers or beams attached thereto which are swung and attached to the outside walls of the barge so that this platform is brought into carrying engagement with the shelf portion provided on the outer walls. All of the load of the crane is transmitted to the walls of the barge and to the pad portions of the rams at the four corners of the barge rather than to the bottom of the barge. An inert gas is fed into the hold of the barge to protect the crane as it is stored below the hatch. A secured hatch cover is provided to cover openings into the barge and they are equipped with gaskets so that the hold is gas-tight and may be flooded with inert gas.

SUMMARY OF THE INVENTION

This invention may be summarized at least in part with reference to its objects.

It is an object of this invention to provide, and it does provide, a barge in which is mounted a crane. This crane is movable up and down by means of elevating screws. When the crane is brought into an operable position above the deck of the barge, the platform upon which the crane is carried is secured by means of arms to the side portions of the barge. Any and all loads lifted by the crane are directly transmitted to the side walls of the barge. A gas-tight hold is provided and inert gas is carried by the barge to be released into the hold of the barge when the crane is carried in a stored condition. A hatchway cover with appropriate gasket means is secured to the barge when the crane is in the stored condition.

It is a further object of this invention to provide, and it does provide, a barge having a crane which is carried on a platform which may be raised and lowered in the hold of the barge. A hatch cover having a gasket which seals the hold to an air-tight condition when the cover is drawn into a tight position prevents the entry of salt air, water and the like and, after sealing, an inert gas supply in the barge is actuated to prevent damage to the crane. At least four hydraulic rams located at the corners of the barge are selectively actuated to bring foot portions attached to and carried by the rams to the bottom of the harbor. These rams are adapted for advancing and causing the barge to be lifted to a level above buoyancy. Means is provided to insure that the load on the crane is transferred from the raised platform to the side hull of the barge and then to the rams.

The barge supported crane, to be hereinafter more fully described, provides inert gas and a sealed hatch cover when the crane is in a stored condition. When the barge is to be placed in position, hydraulic rams at the corners of the barge are provided with pad portions which engage the bottom of the harbor and lift the barge to a position of non-buoyancy. The load on the crane is transferred from its liftable support platform to the outside hull.

In addition to the above summary the following disclosure is detailed to insure adequacy and aid in understanding of the invention. This disclosure, however, is not intended to cover each new inventive concept no matter how it may later be disguised by variations in form or additions of further improvements. For this reason there has been chosen a specific embodiment of the barge with a crane carried thereby as adopted for use by lifting loads from nearby vessels and docks and showing a preferred means for storage of the crane apparatus in the presence of inert gas. This specific embodiment has been chosen for the purposes of illustration and description as shown in the accompanying drawings wherein:

BRIEF DESCRIPTION OF THE DRAWINGS

In the following description and in the claims various details are identified by specific names for convenience. These names, however, are intended to be generic in their application. Corresponding reference characters refer to like members throughout the nine figures of the drawings.

The drawings accompanying, and forming part of, this specification disclose certain details of construction for the purpose of explanation but it should be understood that structural details may be modified in various respects without departure from the concept and that the invention may be incorporated in other structural forms than shown.

DESCRIPTION OF THE PREFERRED EMBODIMENT

Figure 2:
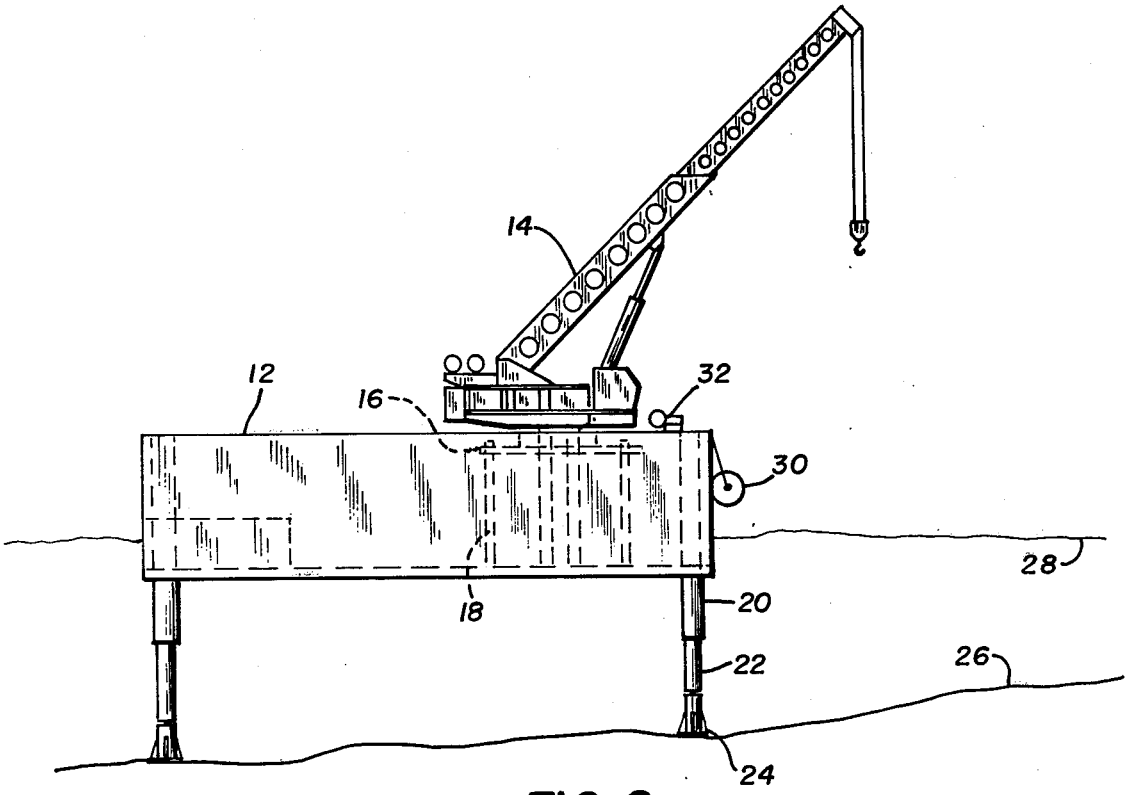
FIG. 2 represents the side view of FIG. 1 with the crane lifted into operating condition above the deck of the barge.
Figure 1:
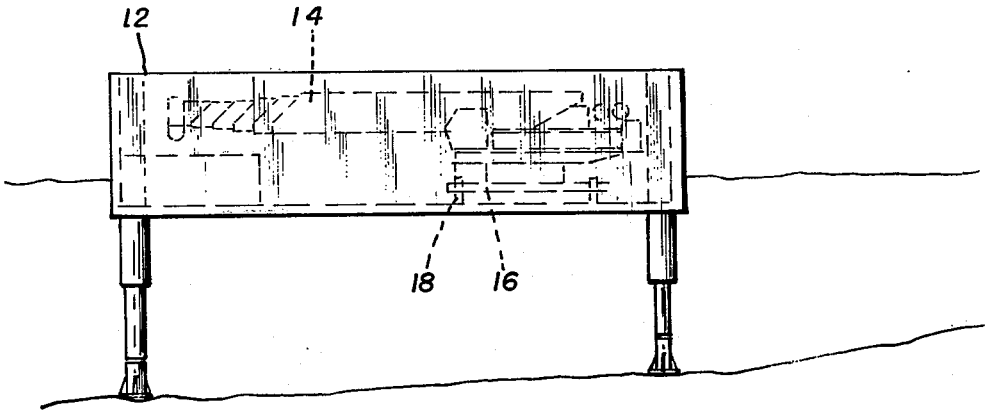
FIG. 1 represents a side view, partly diagrammatic, of the barge-crane of this invention with the crane in a below-deck condition and with the four corner hydraulic rams lowered to engage the harbor bottom and lift the barge above buoyancy.

Referring now to the drawings and in particular to FIGS. 1 and 2, there is depicted a barge generally identified as 12 which may be a powered or towed vessel and, for the purpose of description, is shown generally as rectangular in shape. This barge carries a crane of conventional construction identified generally as 14. This crane is stored in a hold of the barge and for use is raised above the deck of the barge, as shown in FIG. 2. This crane, in operation, is adapted to rotate 360° even in lifting. This crane is carried on a platform 16 and is raised to a lifted condition by means of hydraulic screw jacks 18 which raise and lower the support platform 16 in a controlled manner after the crane is uncovered. On each of the four corners of the barge is a hydraulic jack or ram 20 which has an extending member 22 which carries a foot or spud portion 24. Each hydraulic jack or ram is actuated and the foot or pad 24 engages the bottom of the harbor 26 and further actuation of the ram causes the barge 12 to be lifted to a condition of non-buoyancy above the level of the water 28. Since the bottom of the harbor or bay 26 may be irregular, the travel of the hydraulic rams downwardly is individually adjusted to cause the barge to be lifted to a level condition of non-bouyancy above the water. Shown in FIG. 2 is a bumper 30 which may be raised or lowered by means of a winch 32 of convention construction.

Figure 3:
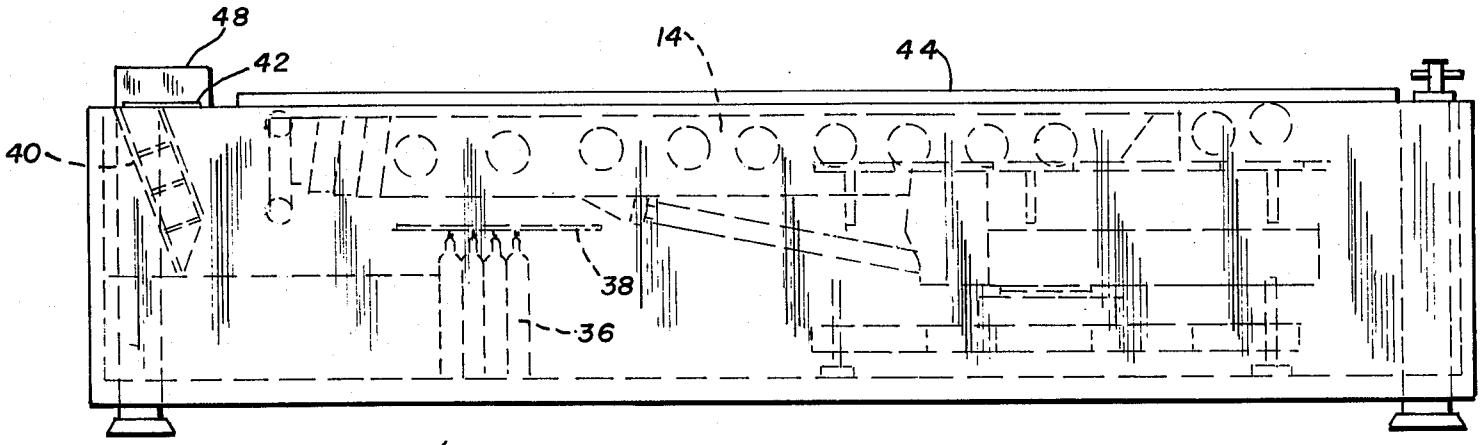
FIG. 3 represents in an enlarged scale a side view of the barge with the crane in the stored condition, and with the hydraulic rams and attached pads in a lifted condition as when the barge is in a condition for towing or movement.

Referring now to FIG. 3, it is to be noted that the barge 12 carries within its hold an inert gas storage supply 36 which is discharged through a manifold 38. An access opening in association with a personnel ladder 40 is shown as carried by this barge. The opening from this ladder has a hatch cover 42. A hatch cover 44 is also provided to cover the opening in the deck of the barge 12 through which the crane 14 is raised or lowered. Automatic ventilation is also provided at opening 48.

Figure 9:
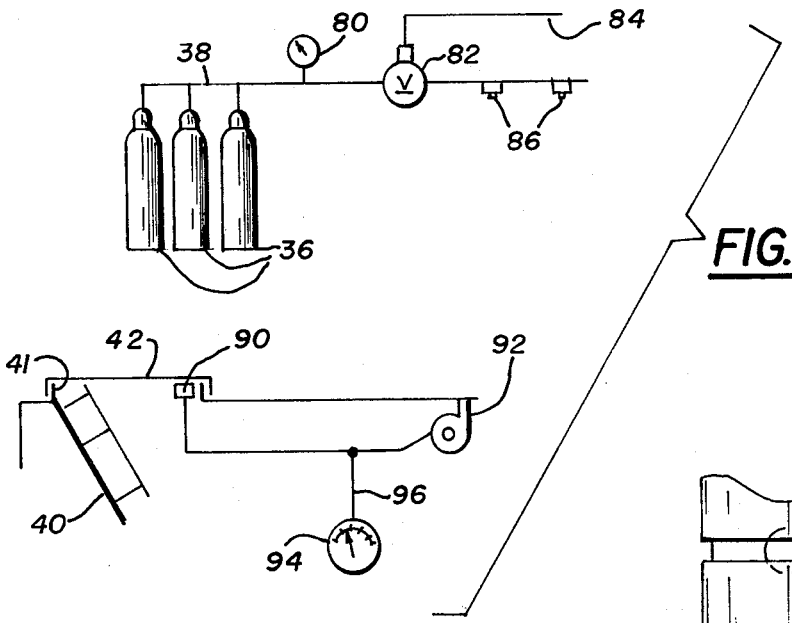
FIG. 9 represents a circuit diagram showing the control of the inert gas as it is monitored for use in the protection of the crane mechanism and machinery during transportation and storage.

As it is to be more fully shown in the circuit diagram of FIG. 9, the use of inert gas in the hold when and as the crane is stored in the sealed hold also requires the expelling of a portion of air from the hold. A signal device indicating that the hold is full of inert gas is also necessary so that an attendant is not exposed to or subject to the effect of a concentration of inert gas. The opening of hatch 42 preferably causes a shutting off of gas from the manifolds 38. A signalling device preferable indicates when the attendant may enter the hold. The removal of hatch cover 44 also helps to dissipate the presence of gas in the hold. A signalling dectector for the presence of excessive concentration of gas is also a necessary precaution.

Figure 4:
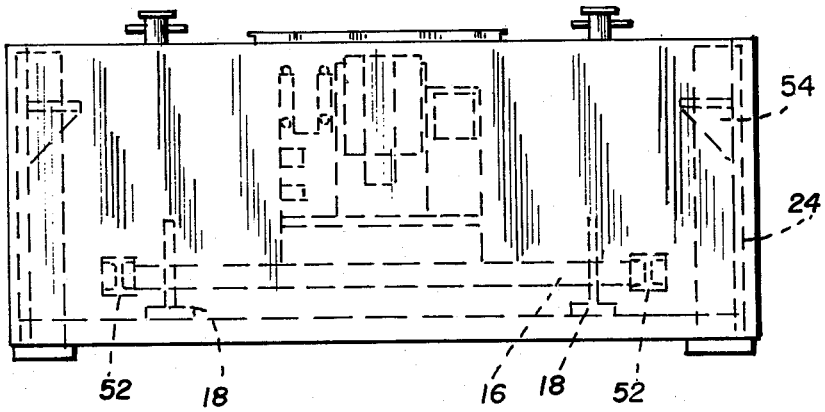
FIG. 4 represents an end view of the barge of FIG. 3 with the crane in a stored condition and the hatch cover in an attached condition and showing the means for transferring the load from the crane to the side walls of the barge.

In FIG. 4 are shown jacks 18 which raise and lower the crane support platform 16. In a raised condition after these jacks have brought the crane to the desired raised condition, as seen in FIG. 2, the arms 52, as carried by the platform 16, are swung either by manual, mechanical or hydraulic means to a position extending outwardly from the platform and toward the side walls of the barge. These support arms are positioned so that each rests upon a support 54. After all arms are positioned to rest on supports 54, the jacks are moved sufficiently to allow whatever load the crane is caused to carry to be transferred from the platform to shelf portion 54 and from there to the side walls of the barge. It is to be noted that hydraulic, electric, pneumatic, mechanical or manual means may be employed to swing these arms into and from their support position. The load of the crane and any load that is accepted and manipulated by the crane is thus transmitted from the platform 16 to the side walls on the barge and then to the rams or pads 24 provided at the four corners of the barge.

Figure 5:
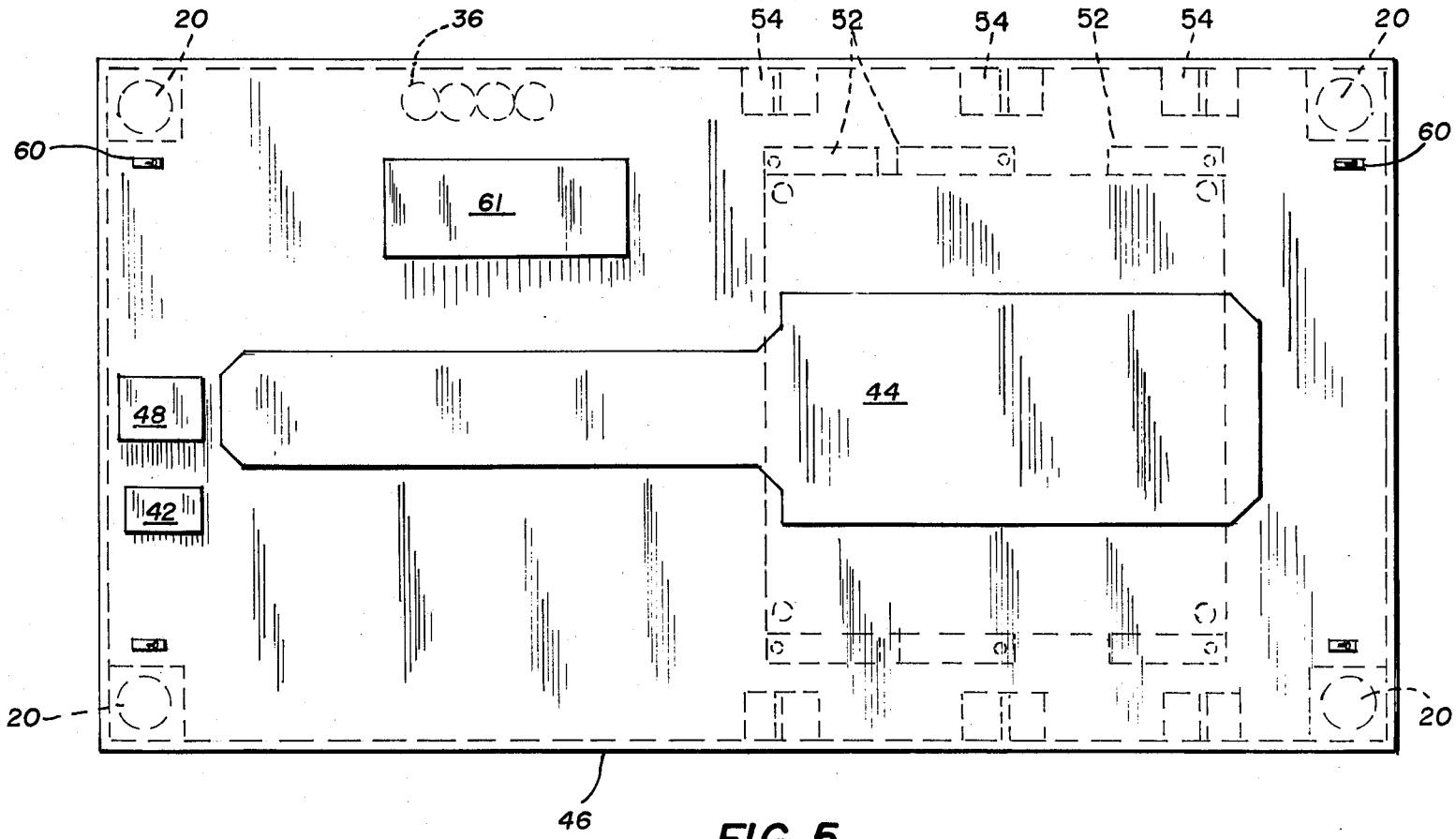
FIG. 5 represents a plan view of the barge of FIG. 3 and showing in detail the storage of the crane and the placement of the hatch and also shown are control means for the hydraulic rams provided at the four corners of the barge.

As seen in FIG. 5, the hydraulic lifting jacks 20 provided at the four corners of the barge are individually controlled by valves 60. Each carrier jack 20 may have a hydraulic reservoir, not shown. Pressure into these reservoirs may be from an inboard or outboard power source. When the hydraulic jack has been lowered to the extent desired to bring the barge to a level condition above wave and tide affect, the valves 60 are individually closed. A hatch 61 may be provided for loading and unloading of the inert gas 36 which is conventionally in pressurized cylinders. Automatic ventilation from access portion 48 is also shown as well as hatch covers 42 and 44.

Figure 6:
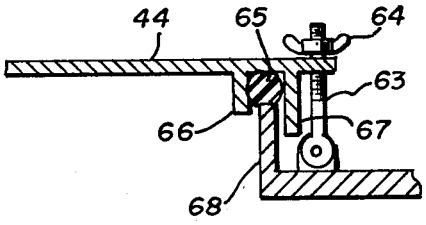
FIG. 6 represents a fragmentary, sectional view showing a method for securing the hatch cover to the deck with the cover sealing the hold.

Hatch Cover Securing As In FIG. 6

Shown in an enlarged view in FIG. 6 is a hatch cover 44 and a typical manner by which hatch covers are retained in position. Swing bolts 63 engage and enter slots in the hatch covers and are tightened with the hatch covers in position by means of wing nuts 64. Gasket 65 engages rib portions 66 and 67 of a hatch cover to provide a gasket seal of the hatch to rim portion 68 on the deck of the barge. This gasket seal enables the interior of the barge to be brought to a substantially air-tight condition and maintained in that condition. In an air-tight condition, the air in the sealed hold is expelled as the inert gas from cylinders 36 is released through manifold 38. Remote action and monitoring of this inert gas is provided so that danger to an operator or attendant is absent.

Figure 7:
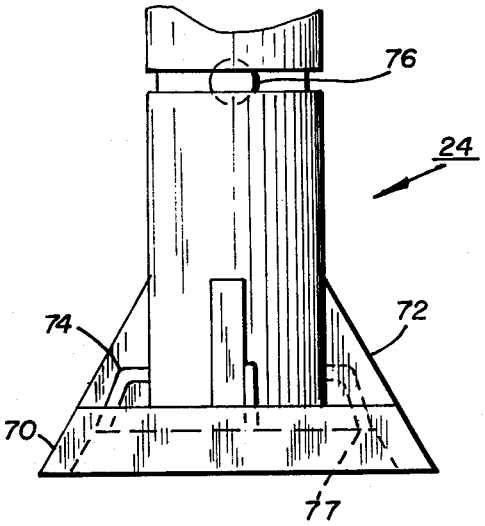
FIG. 7 represents in an enlarged scale a fragmentary view of a bottom of a hydraulically actuacted ram and the foot or pad portion thereof and showing in particular the use of a high-pressure water jet for the release of this foot or pad from the mud or bottom of the harbor or bay.

Support Foot as in FIG. 7

As seen in FIG. 7, there is provided a foot member which may be approximately 6 foot square. This foot member 24, as seen in detail, has a lower down-turned portion 70 which is made as an inverted cup and is supported by means of ribs 72. High-pressure, water jet inlets 74 are provided to the interior of the down-turned cup portion 70 so that removal of this foot or pad portion from the bottom or mud of the harbor may be accomplished with the minimum of effort and to overcome suction. A pivot pin 76 may be provided so that this foot portion 70 may move sufficiently to meet the contour of the harbor floor or bay. When the time comes for moving the barge the foot portions 70 must be lifted. In order to overcome suction of that portion 70 in the mud during withdrawal, there is provided high-pressure water jets 77 which lead from a source not shown to the interior of the down-turned foot portion 70. These high-pressure jets break any developed suction and assist in freeing the foot 70 from the mud. The high-pressure jets are usually employed only during the initial release of the foot portion 70 from its position in the mud or bottom of the harbor.

Figure 8:
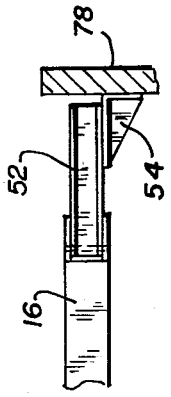
FIG. 8 represents in an enlarged scale, a fragmentary side view showing the method of securing the platform carrying the crane to a side shelf portion attached to the sides of the barge.

Load Arms as in FIG. 8

In FIG. 8 there is shown a fragmentary view of an arm 52 as pivotally mounted on the side of platform 16. There are two or three of these arms on each side of platform 16. As depicted, arm 52 is swung outwardly when the platform is lifted to its "up" operating condition. The outward movement of the arm brings the end portion to a position above a support 54 which is secured to a side wall 78 of the barge 16. The jacks 18 are lowered sufficiently for the load of the crane to be carried by the supports 54.

Not shown is an arrangement in which the arms are carried by the side wall of the barge and are swung into supporting condition when the platform 16 is brought to a raise condition. The arms 52 are hinge mounted or may be hydraulic ram members. The arms may be manipulated manually, hydraulically, pneumatically or electrically mechanically. The means of operation of the arms 52 is merely a matter of selection. It is desirable that the load on the crane be transferred from the lifting jack screws 18 to the side of the barge and then to the four corner lift members 24.

Circuit Diagram of FIG. 9

Referring next and finally to the diagram, as shown in FIG. 9, it is to be noted that gas tanks 36 are depicted as pressure cylinders of conventional construction. They are removably attached to a manifold 38. A pressure gauge 80 may be connected to the manifold to indicate a satisfactory supply of gas. A valve 82 is actuated by a control conductor 84 by which a signal is remotely sent to open or close valve 82. Outlets 86 are provided to disperse the inert gas released from the tanks 36 by the actuated valve 82.

Opening 41, which is associated with steps 40 and cover 42, preferably has a lock 90 which insures that cover 42 is not opened for use of stairs 40 until ventilator 92 draws the inert gas from the hold of the barge and replaces this gas with air sufficient for the hold to be opened and an attendant to enter. An indicator 94, connected by a line 96 to the lock 90, may be provided to insure that the concentration of gas in the hold is reduced to a safe level before the hold is opened.

It is also to be noted that where desired, the barge may be arranged for plural stacking of one barge above another. The foot portions 24 may be removed or enter recess portions on the barge. The several components providing the barge and crane and inert gas storage protection of the crane can be altered to suit specific design concepts. For example, hold sealing by a hatch cover and gasket may be provided by other known means. It is only desirable that the hold be made reasonable gas tight for the release and retaining of the inert gas around the stored crane.

If the harbor bottom in part or is totally too deep for the reach capabilities of the proposed system or where the need exists to provide additional stability, it is proposed fitting swing-away outriggers to the hull sides, one forward and one aft, on both the port and starboard sides of the barge. Such outriggers when retracted would fit into a slot provided in the side of the hull which allows for a clean unobstructed hull line. Such outriggers would be mounted to the barge by way of a trunion arrangement. The outward reach end could be equipped selectively with a vertically functioning hydraulic ram similar to those used in each inboard corner of the barge. These rams when extended would add additional stability to the barge when it is operating in a floating mode. These outriggers, where the conditions warrant may, in part, be arranged to engage a shallow portion, a bank or the like. These outriggers are in addition to the hydraulic lifting members provided on each corner.

It is also to be noted that the platform 16 can be raised by a mechanical jack means or hydraulic rams. Automatic control of corner jacks for self-adjusting of the barge irrespective of the harbor bottom is also contemplated.

Terms such as "up," "down, " "bottom," "top," "front," "back," "in," "out," and the like are applicable to the embodiment shown and described in conjunction with the drawings. These terms are merely for the purposes of description and do not necesssarily apply to the position in which the barge and crane may be constructed or used.

While a particular embodiment of this barge and crane storage in the presence of inert gas has been shown and described it is understood the invention is not limited thereto since modifications may be made within the scope of the accompanying claims and protection is sought to the broadest extent the prior art allows.

What is claimed is:

1. A barge adapted for carrying a crane within the hold portion thereof and in the presence of inert gas, the crane in a raised condition above the deck of the barge adapted to conventionally lift loads and rotate, this barge including: (a) a barge having sides, a bottom and a deck in which an access opening is formed and through which a folded crane may be raised and lowered; (b) at least four corner rams carried by the barge and by hydraulic means and the like, these rams selectively movable downward from the barge to carry a foot portion secured to each corner post toward the bottom of the harbor and when bottom is available the rams having a travel sufficient to engage the bottom and lift the barge to a condition above bouyancy; (c) a crane carried by and on a platform, this platform carried by a plurality of jack means which is actuated to move the platform from a position near the floor of the barge whereat the crane is collapsed and is placed in a stored condition to a position near the deck of the barge so that the crane may be elevated and put to use; (d) means for supporting the crane platform in its lifted condition so as to transfer any and all loads of the crane from said platform to the side walls of the barge as and when the jack means by which the crane platform is lifted is relaxed so that the load of and carried by the crane and the platform is supported by the side walls of the barge; (e) hatch cover means for selectively covering and closing the access opening in the deck when the crane is lowered to a stored condition, this cover means adapted to seal the hold to provide a substantially gas-tight condition, and (f) means feeding a sufficient amount of inert gas into said sealed hold to provide inhibiting protection of the crane and mechanism from spray, salt air and like factors during transport and storage.

2. A barge and crane as in claim 1 in which the inert gas is stored in the hold of the barge in pressurized cylinders connected to a header and this header is connected to at least one outlet with the flow of inert gas from this outlet controlled by a valve which is selectively closed and opened.

3. A barge and crane as in claim 2 in which the valve is only opened when the crane is stored in a below deck and sealed condition.

4. A barge and crane as in claim 3 in which the hatch cover carries a gasket which is brought into a sealing condition as the cover is drawn to the opening by manipulative means carried by the deck.

5. A barge and crane as in claim 4 in which the manipulating means for securing the hatch cover and seal includes an upstanding rim provided about the opening and a plurality of swing bolts pivotally secured at one end to the deck and with the other end of each bolt carrying a nut means which is carried on and manipulated on the threaded end of the swing bolt to draw the hatch cover into a tight, sealed condition with the upstanding rim.

6. A barge and crane as in claim 1 in which each corner ram has its lower foot portion pivotally secured to said ram, each foot portion having at least one high pressure fluid jet leading to the inner portion of the foot so that suction of and by the foot in the mud of the harbor is broken when the high pressure fluid jet is fed high pressure fluid and when the ram and attached foot is to be lifted.

7. A barge and crane as in claim 6 in which the foot portion has a downturned outer rim portion and there is provided a plurality of jets leading to the inside of each foot portion; these jets connected for selectively feeding high pressure fluid to the inside of each foot portion.

8. A barge and crane as in claim 1 in which the jack means for lifting the platform is a plurality of screws which are substantially simultaneously rotated to raise and lower the platform, the lower end of these screws carried by the bottom of the barge.

9. A barge and crane as in claim 8 in which the means for supporting the crane platform includes arm members pivotally secured to the platform and shelf portions secured to the side walls of the barge, the arm members adapted for swinging into seating engagement of the shelf portions after the platform is raised and from said seating engagement when the platform and crane are to be lowered.

10. A barge and crane as in claim 9 in which the arm members are moved into and out of position by remotely controlled means.

11. A barge and crane as in claim 10 in which the means for moving the arms is hydraulic.

12. A barge and crane as in claim 10 in which the means for moving the arms is electromechanical.

13. A barge and crane as in claim 1 in which in addition to the hatch cover for the crane opening there is also a personnel opening and stairs which has a hatch cover and gasket by which this opening is also closed and brought to a substantially air-tight condition.

14. A barge and crane as in claim 13 in which there is additionally provided a signal system by which the interior of the barge is sampled as to the level and presence of inert gas and means is provided to inhibit the use of the personnel opening and stairs until the level and presence of inert gas has been lowered to a safe concentration.

15. A barge and crane as in claim 14 in which the flow of inert gas into the hold is automatically terminated at a signal for preparation of the opening of the personnel access hatch and a ventilator fan is actuated to reduce the concentration of the inert gas in the hold before a lock means inhibiting the release of the access hatch is actuated.

* * * * *